US011761699B2

(12) United States Patent
Jung et al.

(10) Patent No.: US 11,761,699 B2
(45) Date of Patent: Sep. 19, 2023

(54) REFRIGERATOR

(71) Applicant: SAMSUNG ELECTRONICS CO., LTD., Suwon-si (KR)

(72) Inventors: Tae Yun Jung, Suwon-si (KR); Dae Youn Kim, Suwon-si (KE); Jung Keun Park, Suwon-si (KR); Seung Min Lee, Suwon-si (KR); Jeong Man Nam, Suwon-si (KR); Young Gon Park, Suwon-si (KR); Jung Yong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 165 days.

(21) Appl. No.: 17/427,350

(22) PCT Filed: Jan. 29, 2020

(86) PCT No.: PCT/KR2020/001311
§ 371 (c)(1),
(2) Date: Jul. 30, 2021

(87) PCT Pub. No.: WO2020/159206
PCT Pub. Date: Aug. 6, 2020

(65) Prior Publication Data

US 2022/0099358 A1 Mar. 31, 2022

(30) Foreign Application Priority Data

Feb. 1, 2019 (KR) ..... 10-2019-0013767

(51) Int. Cl.
*F25D 23/06* (2006.01)
*F25D 23/02* (2006.01)
*F25D 23/08* (2006.01)

(52) U.S. Cl.
CPC ..... *F25D 23/063* (2013.01); *F25D 23/028* (2013.01); *F25D 23/065* (2013.01); *F25D 23/087* (2013.01); *F25D 2201/12* (2013.01)

(58) Field of Classification Search
CPC .... F25D 23/063; F25D 23/028; F25D 23/065; F25D 23/087; F25D 2201/12; F25D 2400/40; H01R 13/5219; H01R 13/52
See application file for complete search history.

(56) References Cited

U.S. PATENT DOCUMENTS 2,647,287 A * 8/1953 Jones ..... E04B 1/34321 D25/33
3,587,199 A 6/1971 Henry
(Continued)

FOREIGN PATENT DOCUMENTS

DE 89 06 131.4 6/1989
DE 42 24 250 A1 1/1992
(Continued)

OTHER PUBLICATIONS

The Extended European Search Report dated Jan. 31, 2022 in European Patent Application No. 20749318.0 (7 pages).
(Continued)

*Primary Examiner* — Hanh V Tran
(74) *Attorney, Agent, or Firm* — STAAS & HALSEY LLP

(57) ABSTRACT

A refrigerator includes a main body including a plurality of wall modules, a storeroom disposed inside the main body, and a door arranged to open or close the storeroom. The plurality of wall modules include a first wall module having a concave portion and a second wall module having a convex portion engaged with the concave portion. The convex portion includes an insulation filling space in which insulation is filled, and a fastening groove. A fastening member is inserted into the fastening groove so as to be
(Continued)

fastened to the first wall module and the second wall module.

12 Claims, 15 Drawing Sheets

(56) References Cited

U.S. PATENT DOCUMENTS

| | | | | |
|---|---|---|---|---|
| 4,417,430 | A * | 11/1983 | Loikitz | F25D 23/065 52/582.2 |
| 4,512,122 | A * | 4/1985 | Berkowitz | E04B 1/6183 292/DIG. 53 |
| 6,119,427 | A * | 9/2000 | Wyman | E04C 2/292 52/584.1 |
| 8,776,472 | B1 * | 7/2014 | Kinser, Jr. | E04B 1/80 52/584.1 |
| 10,468,812 | B1 * | 11/2019 | Lee | H01R 13/24 |
| 11,181,315 | B2 * | 11/2021 | Costanza | E04B 1/34321 |
| 11,333,420 | B2 * | 5/2022 | Makoto | F25D 23/063 |
| 2007/0033960 | A1 * | 2/2007 | Egan | F25D 23/069 62/389 |
| 2007/0152551 | A1 * | 7/2007 | Kim | F25D 23/063 312/401 |
| 2007/0228907 | A1 | 10/2007 | Luisi et al. | |
| 2011/0162403 | A1 * | 7/2011 | Selin | F25D 23/063 62/449 |
| 2011/0173925 | A1 * | 7/2011 | Brown | F25D 23/06 52/794.1 |
| 2015/0192355 | A1 * | 7/2015 | Joo | F25D 29/005 312/401 |
| 2017/0025790 | A1 * | 1/2017 | Jaworek | H01R 13/506 |
| 2017/0370632 | A1 * | 12/2017 | Jeong | F25D 23/065 |
| 2018/0017314 | A1 * | 1/2018 | Jeong | F25D 23/061 |
| 2018/0112912 | A1 * | 4/2018 | Lindel | F25D 27/00 |
| 2021/0057851 | A1 * | 2/2021 | Lund | A61B 5/742 |

FOREIGN PATENT DOCUMENTS

| | | | | |
|---|---|---|---|---|
| FR | 1 598 102 | | 6/1970 | |
| JP | 7-29190 | | 7/1995 | |
| JP | 8-148228 | | 6/1996 | |
| JP | 9-264491 | | 10/1997 | |
| KR | 10-0684550 | | 2/2007 | |
| KR | 10-0763853 | B1 | 10/2007 | |
| KR | 10-2010-0060996 | | 6/2010 | |
| KR | 10-1011531 | | 1/2011 | |
| KR | 10-2011-0120539 | | 11/2011 | |
| KR | 10-1245263 | | 4/2013 | |
| KR | 20180066497 | A * | 7/2014 | |
| KR | 10-2015-0081598 | | 7/2015 | |
| KR | 10-2016-0044842 | | 4/2016 | |
| KR | 10-1680382 | | 11/2016 | |
| WO | WO-2014103773 | A1 * | 7/2014 | F25D 23/063 |

OTHER PUBLICATIONS

International Search Report and Written Opinion (Forms PCT/ISA/210 and PCT/ISA/237), dated Jun. 2, 2020 in International Application No. PCT/KR2020/001311 (translation of International Search Report).

* cited by examiner

REFRIGERATOR

CROSS-REFERENCE TO RELATED APPLICATIONS

This application is a U.S. national stage of International Application No. PCT/KR2020/001311, filed on Jan. 29, 2020. The International Application claims the priority benefit of Korean Patent Application No. 10-2019-0013767 filed on Feb. 1, 2019. Both International Application No. PCT/KR2020/001311 and Korean Patent Application No. 10-2019-0013767 are incorporated by reference herein in their entirety.

BACKGROUND

1. Field

The disclosure relates to a refrigerator, and for example, to a refrigerator with a main body formed by assembling a plurality of wall modules.

2. Description of Related Art

Refrigerators are home appliances equipped with a main body having a storage chamber, a cold air supplier for supplying cold air to the storage chamber and a door for opening or closing the storage chamber to keep food fresh.

In general, the main body of the refrigerator is manufactured by molding inner and outer cases, assembling the outer case onto the outside of the inner case, and injecting and foaming insulation between the inner and outer cases.

This method requires more workforce, expenses and time in manufacturing and managing the main body due to the bulky inner and outer cases, and it is impossible to disassemble the main body after the insulation is foamed.

SUMMARY

According to an embodiment of the disclosure, a refrigerator includes a main body including a plurality of wall modules, a storeroom formed inside the main body to store foods, and a door arranged to open or close the storeroom, wherein the plurality of wall modules include a first wall module having a concave portion, and a second wall module having a convex portion engaged with the concave portion, and wherein the convex portion includes an insulation filling space in which insulation is filled, and a fastening groove to which a fastening member is fastened to fix the first wall module and the second wall module.

The insulation filling space and the fastening groove may be formed not to be interconnected.

The convex portion may include an outer wall, an inner wall, and a top wall connecting between the outer wall and the inner wall.

The convex portion may include a partition wall separating the insulation filling space from the fastening groove.

The fastening member may be fastened in a direction from the outer wall toward the inner wall.

The first wall module may include a guide projection formed to protrude from the concave portion, and the second wall module may include a guide groove formed to be sunken from the convex portion.

The concave portion may include an outer wall, an inner wall, and a bottom wall connecting between the outer wall and the inner wall, and the guide projection may protrude from the bottom wall.

The guide projection may include a sloped guide surface formed to slope to the bottom wall to adjust a position of the guide projection when the guide projection is inserted to the guide groove.

The guide projection may include a vertical guide surface formed to be perpendicular to the bottom wall between the sloped guide surface and the bottom wall.

The guide projection may be symmetrically formed with respect to a central surface perpendicular to a direction of length of the concave portion.

The refrigerator may further include a plurality of connectors arranged in the first wall module and the second wall module to have the first wall module and the second wall module interconnected when the first and second wall modules are coupled together.

The plurality of connectors may include a first connector installed in the concave portion and a second connector installed in the convex portion.

The plurality of connectors may include a first connector having a sealing groove equipped with a sealing member, and a second connector having a pressurizing rib protruding to pressurize the sealing member when coupled to the first connector.

According to another embodiment of the disclosure, a refrigerator includes a main body including a plurality of wall modules, a storeroom formed inside the main body to store foods, and a door arranged to open or close the storeroom, wherein the plurality of wall modules include a first wall module having a concave portion, and a first connector installed in the concave portion, and a second wall module having a convex portion to be engaged with the concave portion and a second connector installed in the convex portion to be connected to the first connector.

The concave portion may include an outer wall, an inner wall, and a bottom wall connecting between the outer wall and the inner wall, and the first connector may be installed to penetrate the bottom wall.

The convex portion may include an outer wall, an inner wall, and a top wall connecting between the outer wall and the inner wall, and the first connector may be installed to penetrate the top wall.

One of the first connector and the second connector may include a sealing groove equipped with a sealing member, and the other one may include a pressurizing rib protruding to pressurize the sealing member.

The first connector and the second connector may each include a connector case, and the connector case may include a first installation part arranged for a first terminal housing to be mounted therein and a second installation part arranged for a second terminal housing of a size different from the first terminal housing to be mounted therein.

The first connector and the second connector may be coupled to the connector case to cover an open side of the connector case and may include a connector cover supporting the terminal housing mounted in the connector case.

BRIEF DESCRIPTION OF THE DRAWINGS

The above and other aspects, features and advantages of the disclosure will become more apparent from the following description of example embodiments with reference to the accompanying drawings, in which.

DETAILED DESCRIPTION

Figure 1:
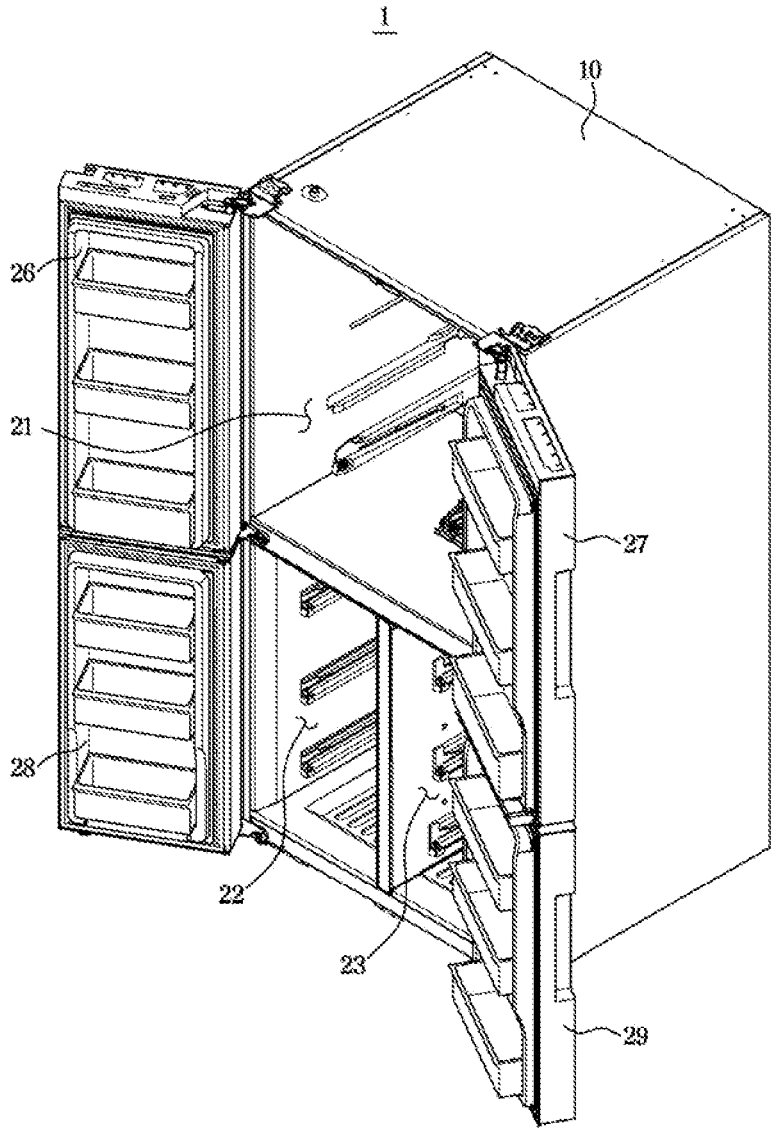
FIG. 1 is a perspective view of a refrigerator, according to an embodiment of the disclosure.

Embodiments of the disclosure are examples and provided to assist in understanding the disclosure as defined by the claims and their equivalents. Accordingly, various changes and modifications of the embodiments described herein can be made without departing from the scope and spirit of the disclosure.

As used herein, the singular forms "a", "an" and "the" are intended to include the plural forms as well, unless the context clearly indicates otherwise. For the sake of clarity, the elements of the drawings are drawn with exaggerated forms and sizes.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When it is stated in the disclosure that one element is "connected to" or "coupled to" another element, the expression encompasses an example of a direct connection or direct coupling, as well as a connection or coupling with another element interposed therebetween.

It will be understood that, although the terms first, second, third, etc., may be used herein to describe various elements, the elements are not limited by these terms. These terms are used to distinguish one element from another element. For example, without departing from the scope of the disclosure, a first element may be termed as a second element, and a second element may be termed as a first element.

The scope of the expression or phrase of "and/or" includes a plurality of combinations of relevant items or any one item among a plurality of relevant items. For example, the scope of the expression or phrase "A and/or B" includes the item "A", the item "B", and the combination of items "A and B".

In addition, the scope of the expression or phrase "at least one of A and B" is intended to include all of the following: (1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

An aspect of the disclosure provides a refrigerator having a main body formed by assembling a plurality of wall modules.

Another aspect of the disclosure provides an assembling structure of a plurality of wall modules, and a refrigerator having the assembling structure, which facilitates assembling and reduces a defect rate.

Another aspect of the disclosure provides an assembling structure of a plurality of wall modules, and a refrigerator having the assembling structure, which has durability and airtightness.

Another aspect of the disclosure provides connectors and installation structure thereof electrically connecting a plurality of wall modules at the same time when the plurality of wall modules are assembled, and a refrigerator having the structure.

According to embodiments of the disclosure, a main body of a refrigerator may be formed by assembling a plurality of wall modules.

According to embodiments of the disclosure, the plurality of wall modules may be assembled easily and accurately.

According to embodiments of the disclosure, the main body formed by assembling the plurality of wall modules may have durability and airtightness.

According to embodiments of the disclosure, a plurality of connectors installed at the plurality of wall modules may be interconnected when the plurality of wall modules are assembled.

According to embodiments of the disclosure, the plurality of wall modules may be disassembled back after assembled. Accordingly, only some of the plurality of wall modules may be repaired or replaced.

Reference will now be made in detail to embodiments of the disclosure with reference to accompanying drawings.

Figure 2:
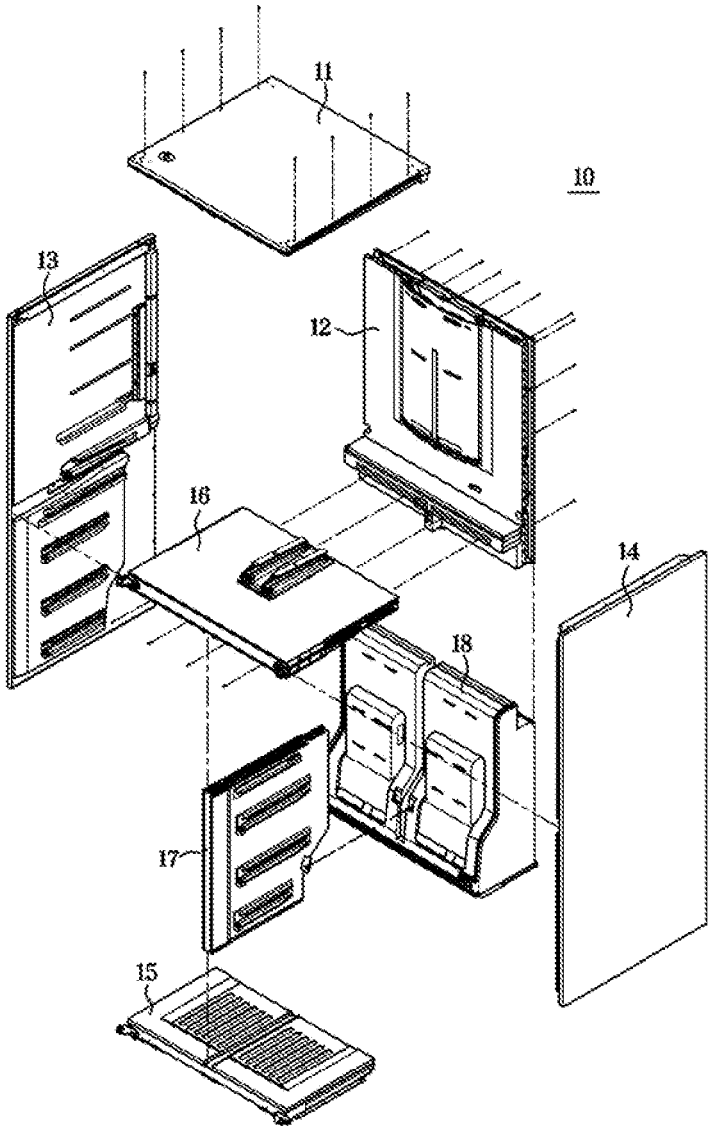
FIG. 2 shows the refrigerator of FIG. 1 with a plurality of wall modules disassembled.

FIG. 1 is a perspective view of a refrigerator, according to an embodiment of the disclosure. FIG. 2 shows the refrigerator of FIG. 1 with a plurality of wall modules disassembled.

Referring to FIGS. 1 and 2, a refrigerator 1 may include a main body 10, storerooms 21, 22, and 23 formed inside the main body 10 to store foods, doors 26, 27, 28, and 29 to open or close the storerooms 21, 22, and 23, and a cold air supply arranged to supply cold air to the storerooms 21, 22, and 23.

The main body 10 may be formed by combining a plurality of wall modules 11 to 17 and a cooling module 18. The plurality of wall modules 11 to 17 may define the storerooms 21, 22, and 23. The plurality of wall modules 11 to 17 may include insulation to insulate the storerooms 21, 22, and 23.

The plurality of wall modules 11 to 17 may include a top wall module 11, a rear wall module 12, a left wall module 13, a right wall module 14, a bottom wall module 15, a horizontal middle wall module 16, and a vertical middle wall module 17. The storerooms 21, 22, and 23 may be partitioned by the horizontal middle wall module 16 into an upper storeroom 21 and lower storerooms 22 and 23. The lower storerooms 22 and 23 may be partitioned by the vertical middle wall module 17 into the storerooms 22 and 23.

The cold air supply may be provided in the cooling module 18. The cold air supply may include an evaporator (not shown), a compressor (not shown), a condenser (not shown), and an expansion device (not shown), and use latent heat of vaporization of refrigerant to produce cold air. The cold air produced from the cold air supply may be supplied directly into the storerooms 22 and 23 or into the storeroom 21 via the rear wall module 12. Cold air discharge holes 12*a*, through which to supply the cold air into the storeroom 21, may be formed at the rear wall module 12.

The plurality of wall modules 11 to 17 may have the form of substantially rectangular panels to be easily loaded. The plurality of wall modules 11 to 17 may each be formed with a case and insulation arranged in the case. The plurality of wall modules 11 to 17 may be assembled together and may later be disassembled back. A coupling structure of the plurality of wall modules 11 to 17 will now be described in detail.

Figure 3:
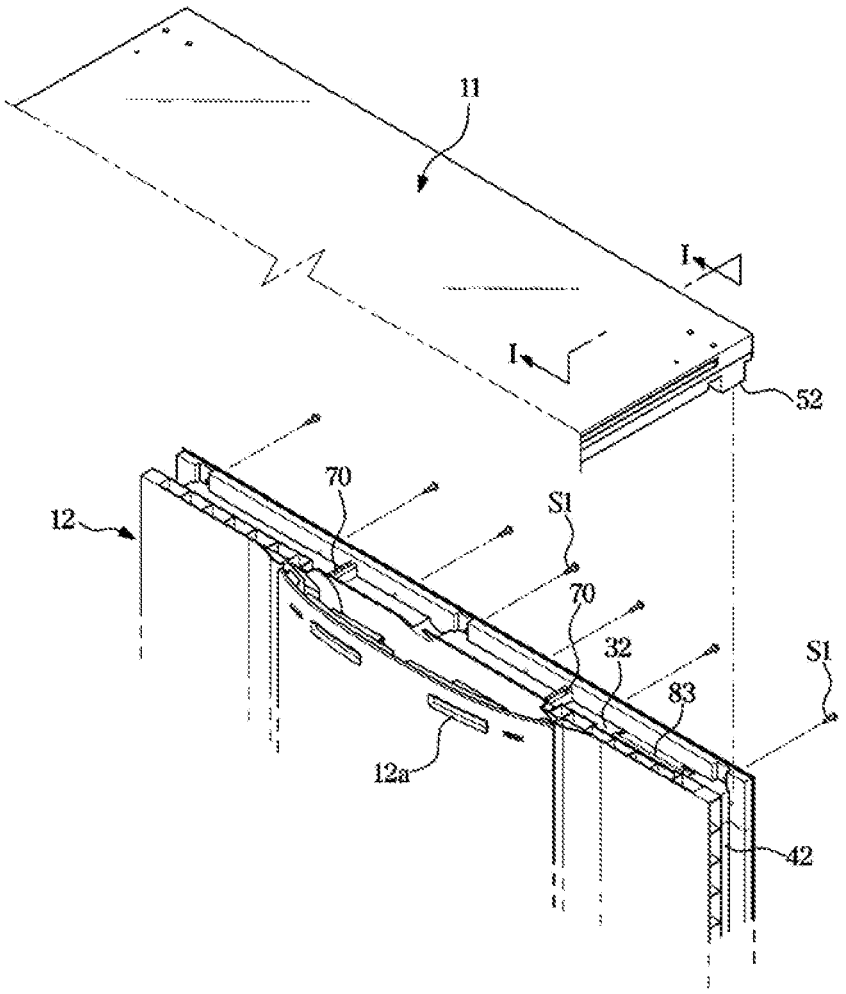
FIG. 3 shows a coupling structure between a rear wall module and a top wall module of the refrigerator of FIG. 1.
Figure 4:
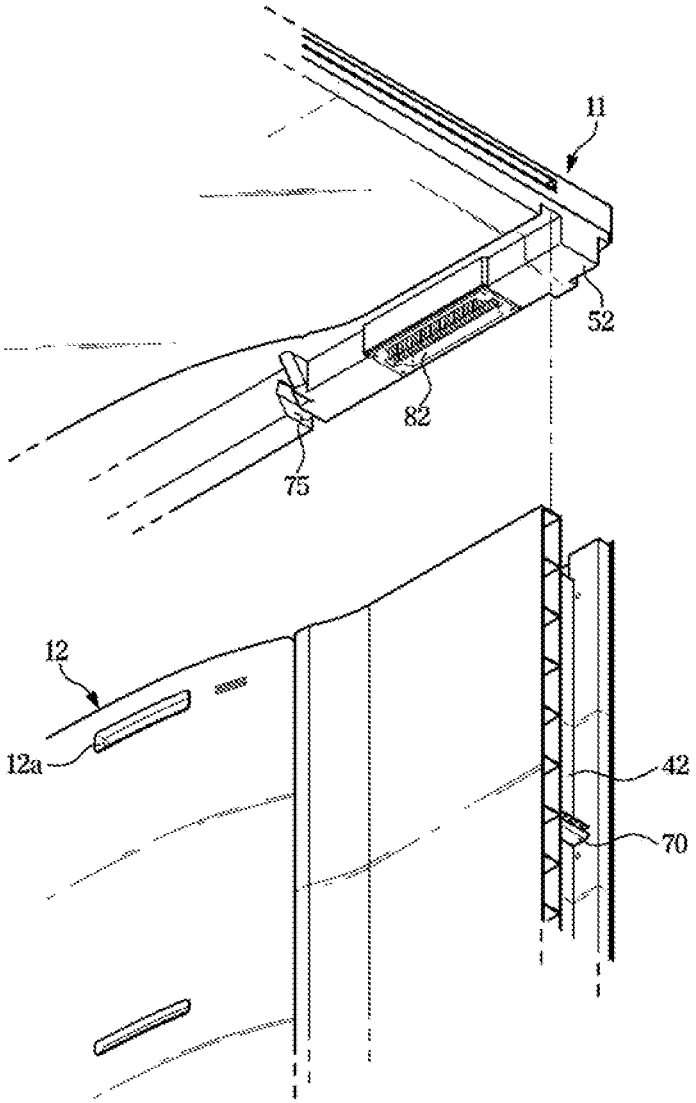
FIG. 4 shows a coupling structure between a rear wall module and a top wall module of the refrigerator of FIG. 1 viewed from a different angle.
Figure 5:
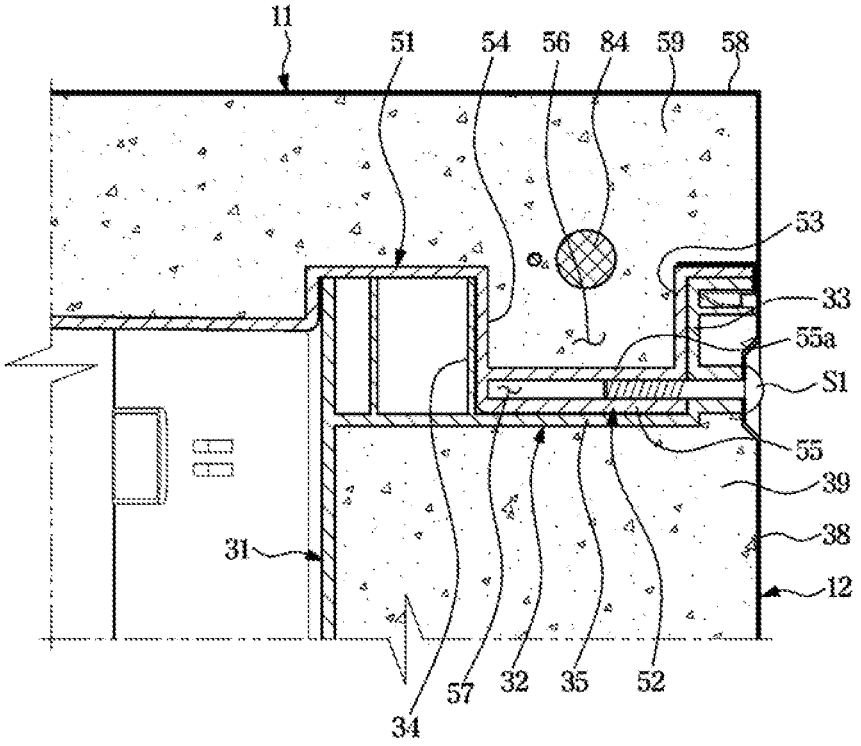
FIG. 5 is a cross-sectional view along line I-I of FIG. 3.
Figure 6:
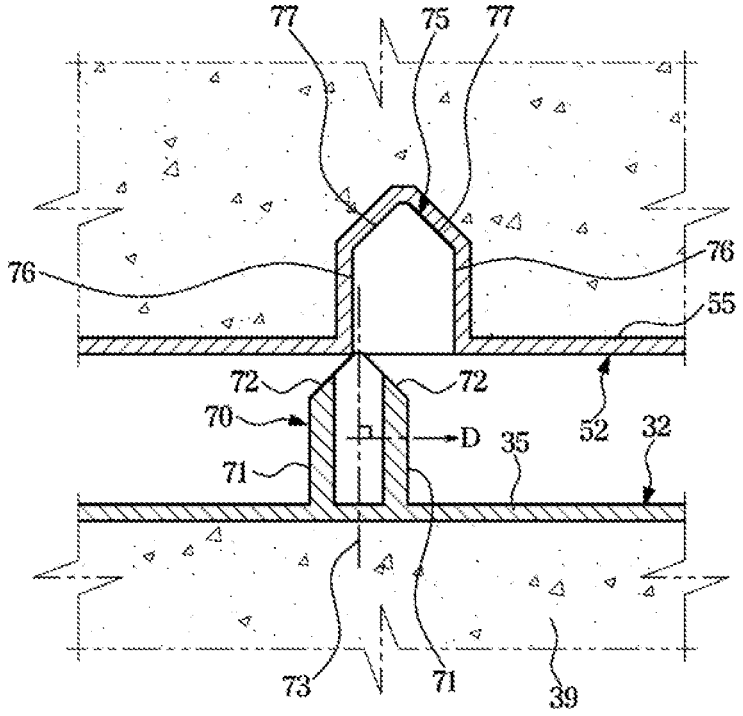
FIG. 6 shows a guide projection and a guide groove of the refrigerator of FIG. 1.

FIG. 3 shows a coupling structure between the rear wall module and the top wall module of the refrigerator of FIG. 1. FIG. 4 shows a coupling structure between the rear wall module and the top wall module of the refrigerator of FIG. 1 viewed from a different angle. FIG. 5 is a cross-sectional view along line I-I of FIG. 3. FIG. 6 shows a guide projection and a guide groove of the refrigerator of FIG. 1.

Referring to FIGS. 3 to 6, a coupling structure between the top wall module and the rear wall module of the refrigerator according to an embodiment of the disclosure is described.

The top wall module 11 and the rear wall module 12 may be coupled such that a convex portion 52 of the top wall module 11 is engaged with a concave portion 32 of the rear wall module 12, and then fastened by a fastening member S1.

Although in this embodiment, the convex portion 52 is arranged at the top wall module 11 and the concave portion 32 is arranged at the rear wall module 12, it is not limited thereto and on the contrary, a concave portion may be arranged at the top wall module 11 and a convex portion may be arranged at the rear wall module 12.

For example, the rear wall module 12 may include an inner case 31, an outer case 38 coupled onto the outer surface of the inner case 31, and insulation 39 provided between the inner case 31 and the outer case 38. The insulation 39 may include foam insulation. For example, the insulation may be molded by injecting a foaming liquid, in which urethane and a foaming agent are mixed up, into internal space formed by the inner case 31 and the outer case 38 and then foaming the foaming liquid.

The rear wall module 12 may have the form of a substantially rectangular panel and may be vertically arranged. The top end of the rear wall module 12 may be coupled to the rear end of the top wall module 11. The concave portion 32 may be formed at the top end of the rear wall module 12. The concave portion 32 may be formed to extend along a direction of the top edges of the rear wall module 12.

From a different perspective, the inner case 31 of the rear wall module 12 may include the concave portion 32. The concave portion 32 may include an outer wall 33, an inner wall 34, and a bottom wall 35 connecting between the outer wall 33 and the inner wall 34. The outer wall 33 and the inner wall 34 may be formed in parallel to face each other. The outer wall 33 may be formed on a farther outside than the inner wall 34 with respect to the storeroom 21.

The top wall module 11 may include an inner case 51, an outer case 58 coupled onto the outer surface of the inner case 51, and insulation 59 provided between the inner case 51 and the outer case 58. The insulation 59 may include foam insulation.

The top wall module 11 may have the form of a substantially rectangular panel and may be horizontally arranged. The rear end of the top wall module 11 may be coupled to the top end of the rear wall module 12. The convex portion 52 may be formed at the rear end of the top wall module 11. The convex portion 52 may be formed to extend along a direction of the rear edges of the top wall module 11.

From a different perspective, the inner case 51 of the top wall module 11 may include the convex portion 52. The convex portion 52 may include an outer wall 53, an inner wall 54, and a top wall 55 connecting between the outer wall 53 and the inner wall 54. The outer wall 53 and the inner wall 54 may be formed in parallel to face each other. The outer wall 53 may be formed on a farther outside than the inner wall 54 with respect to the storeroom 21.

The convex portion 52 may include an insulation filling space 56 where the insulation 59 is filled. As the insulation 59 is filled in the insulation filling space 56, the convex portion 52 may have enough rigidity.

The convex portion 52 may be engaged with the concave portion 32. That is, the convex portion 52 may be inserted into the concave portion 32. The outer wall 53 of the convex portion 52 may adjoin the outer wall 33 of the concave wall 33, the top wall 55 of the convex portion 52 may adjoin the bottom wall 35 of the concave portion 32, and the inner wall 54 of the convex portion 52 may adjoin the inner wall 34 of the concave portion 32. In this way, the convex portion 52 comes into contact with the concave portion 32 on three sides, so that coupling power and airtightness between the top wall module 11 and the rear wall module 12 may increase.

After the convex portion 52 of the top wall module 11 and the concave portion 32 of the rear wall module 12 are assembled to be engaged with each other, the fastening member S1 may be fastened to the top wall module 11 and the rear wall module 12. The fastening member S1 may be fastened to the convex portion 52 of the top wall module 11 by penetrating the outer case 38 and the inner case 31 of the rear wall module 12.

For this, a fastening groove 57 to which the fastening member S1 is fastened may be formed at the convex portion 52. The fastening member S1 may be a screw with an outer circumferential surface on which a thread is formed. A thread may be formed on an inner circumferential surface of the fastening groove 57 to correspond to the screw.

The fastening groove 57 may be formed not to be connected to the insulation filling space 56 to prevent the foaming liquid injected and foamed in the insulation filling space 56 from leaking into the fastening groove 57. That is, the convex portion 52 may include a partition wall 55*a* formed to partition the insulation filling space 56 from the fastening groove 57. The fastening member S1 may be fastened in a direction from the outer wall 53 of the convex portion 52 to the inner wall 54.

In this way, the convex portion 52 and the concave portion 32 are assembled to be engaged with each other and the fastening member S1 is then fastened to the convex portion 52, thereby improving coupling power and airtightness between the top wall module 11 and the rear wall module 12.

The refrigerator may include a guide projection 70 and a guide groove 75 to adjust and guide the positions of the top wall module 11 and the rear wall module 12 when the top wall module 11 and the rear wall module 12 of are assembled.

For example, the rear wall module 12 may include the guide projection 70 formed to protrude at the concave portion 32, and the top wall module 11 may include the guide groove 75 formed to be sunken at the convex portion 52 to correspond to the guide projection 70.

The guide projection 70 may be formed to protrude from the bottom wall 35 of the concave portion 32. The guide projection 70 may include a sloped guide surface 72 formed to slope to the bottom wall 35 to adjust a position of the guide projection 70 when the guide projection 70 is inserted to the guide groove 75.

The guide projection 70 may include a vertical guide surface 71 formed to be perpendicular to the bottom wall 35 between the sloped guide surface 72 and the bottom wall 35. The vertical guide surface 71 may guide the guide projection 70 moving straight into the guide groove 75.

The guide projection 70 may be symmetrically formed with respect to a central surface 73 of the guide projection, which is perpendicular to a direction D of the length of the concave portion 32.

The guide groove 75 may be formed to correspond to the guide projection 70. The guide groove 75 may include a vertical matching surface 76 corresponding to the vertical guide surface 71 of the guide projection 70, and a sloped matching surface 77 corresponding to the sloped guide surface 72 of the guide projection 70.

The guide projection 70 and the guide groove 75 may enable the top wall module 11 and the rear wall module 12 to be assembled easily and accurately without an error.

The top wall module 11 may include a connector 82 (in FIG. 4), and the rear wall module 12 may include a connector 83 (in FIG. 3) to be coupled to the connector 82. The connector 82 and the connector 83 may be interconnected when the top wall module 11 and the rear wall module 12 are assembled. Accordingly, an extra process to electrically connect between the top wall module 11 and the rear wall module 12 may not be required after the top wall module 11 and the rear wall module 12 are assembled.

The connector 82 may be installed at the convex portion 52 of the top wall module 11. The connector 83 may be installed at the concave portion 32 of the bottom wall module 12. A detailed structure of the connectors 82 and 83 will be described later. In FIG. 5, electrical wiring 84 is installed at the top wall module 11.

Figure 7:
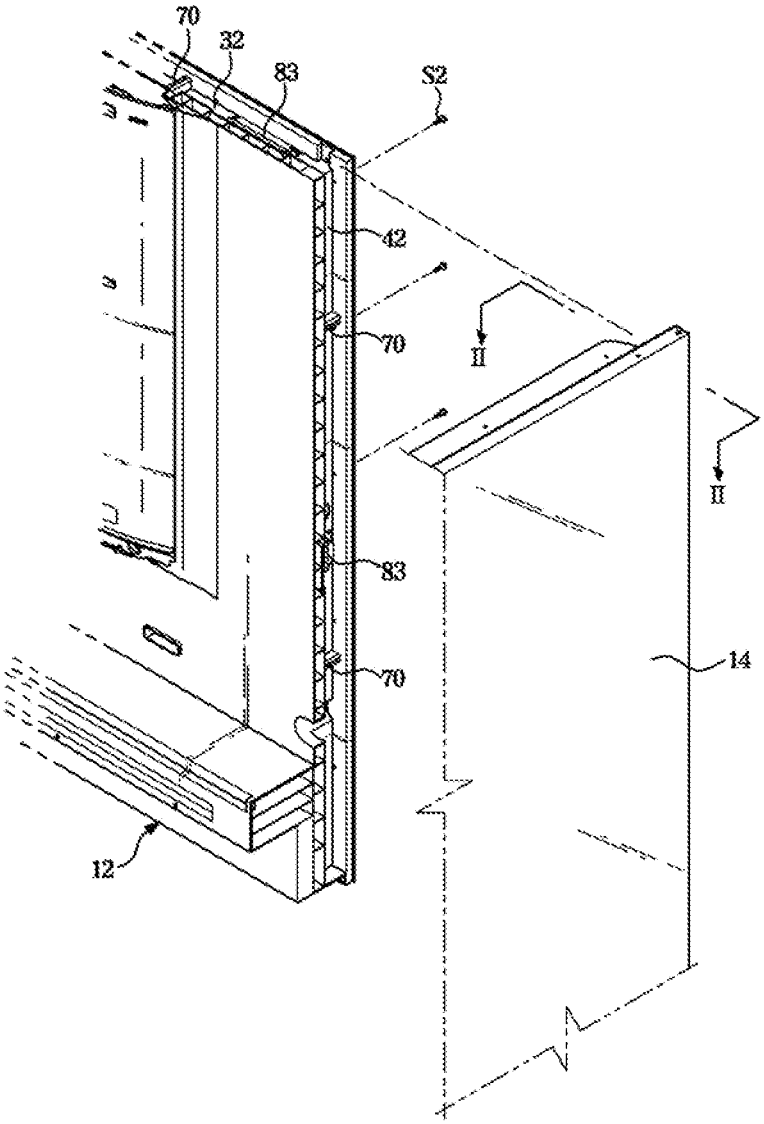
FIG. 7 shows a coupling structure between a rear wall module and a right wall module of the refrigerator of FIG. 1.
Figure 8:
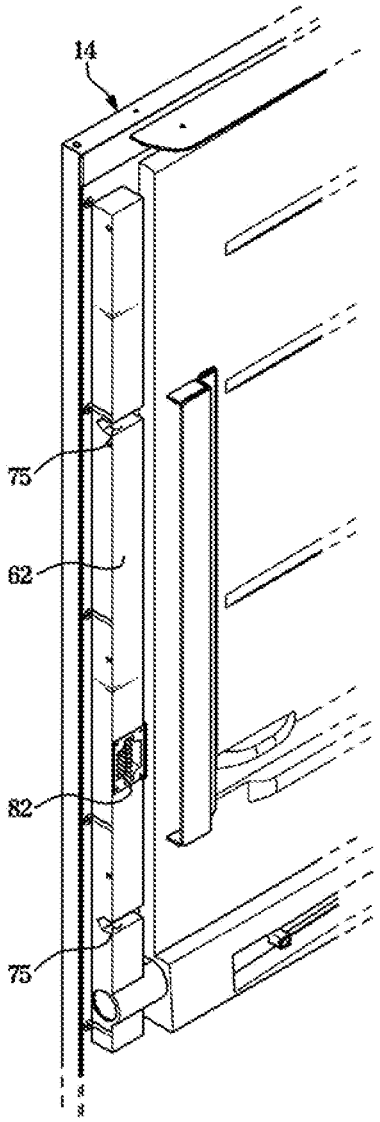
FIG. 8 shows a coupling structure between a rear wall module and a right wall module of the refrigerator of FIG. 1 viewed from a different angle.
Figure 9:
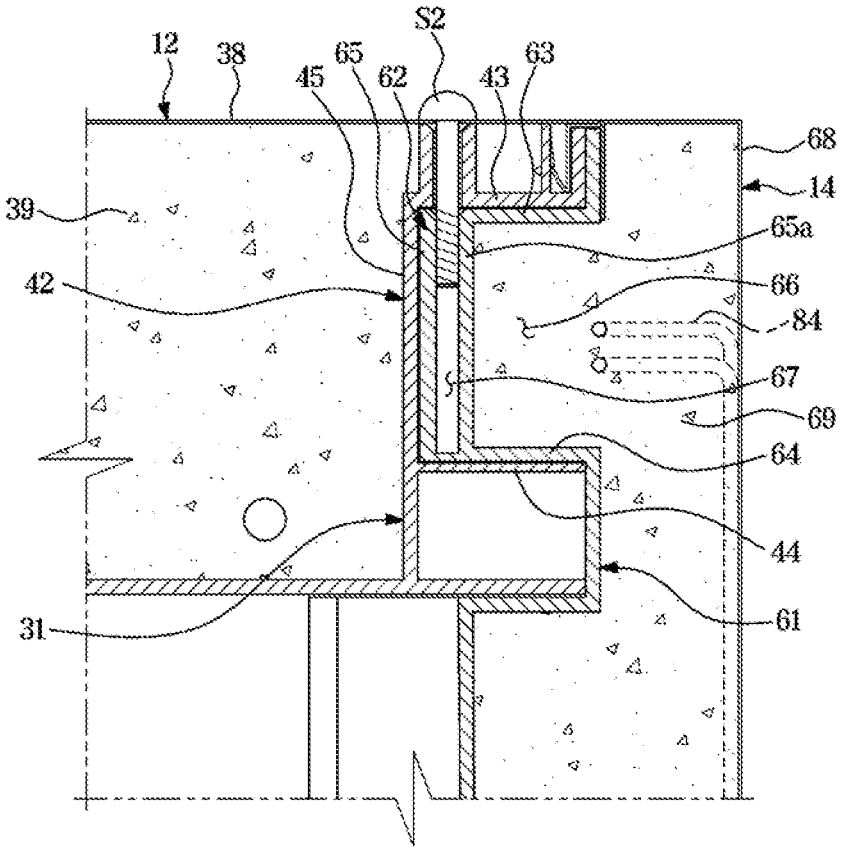
FIG. 9 is a cross-sectional view along line II-II of FIG. 7.

FIG. 7 shows a coupling structure between the rear wall module and the right wall module of the refrigerator of FIG. 1. FIG. 8 shows a coupling structure between the rear wall module and the right wall module of the refrigerator of FIG. 1 viewed from a different angle. FIG. 9 is a cross-sectional view along line II-II of FIG. 7.

Referring to FIGS. 7 to 9, a coupling structure between the right wall module and the rear wall module of the refrigerator according to an embodiment of the disclosure is described. Descriptions overlapping with the aforementioned coupling structure between the top wall module and the rear wall module will not be repeated.

The right wall module 14 and the rear wall module 12 may be coupled when a convex portion 62 of the right wall module 14 is engaged with a concave portion 42 of the rear wall module 12 and then fastened by a fastening member S2.

Although in this embodiment, the convex portion 62 is arranged at the right wall module 14 and the concave portion 42 is arranged at the rear wall module 12, it is not limited thereto and on the contrary, a concave portion may be arranged at the right wall module 14 and a convex portion may be arranged at the rear wall module 12.

For example, the rear wall module 12 may include the inner case 31, the outer case 38 coupled onto the outer surface of the inner case 31, and the insulation 39 provided between the inner case 31 and the outer case 38.

The rear wall module 12 may have the form of a substantially rectangular panel and may be vertically arranged. The right end of the rear wall module 12 may be coupled to the rear end of the right wall module 14. The concave portion 42 may be formed at the right end of the rear wall module 12. The concave portion 42 may be formed to extend along a direction of the right edges of the rear wall module 12.

From a different perspective, the inner case 31 of the rear wall module 12 may include the concave portion 42. The concave portion 42 may include an outer wall 43, an inner wall 44, and a bottom wall 45 connecting between the outer wall 43 and the inner wall 44. The outer wall 43 and the inner wall 44 may be formed in parallel to face each other. The outer wall 43 may be formed on a farther outside than the inner wall 44 with respect to the storeroom 21.

The right wall module 14 may include an inner case 61, an outer case 68 coupled onto the outer surface of the inner case 61, and insulation 69 provided between the inner case 61 and the outer case 68. The insulation 69 may include foam insulation.

The right wall module 14 may have the form of a substantially rectangular panel and may be vertically arranged. The rear end of the right wall module 14 may be coupled to the right end of the rear wall module 12. The convex portion 62 may be formed at the rear end of the right wall module 14. The convex portion 62 may be formed to extend along a direction of the rear edges of the right wall module 11.

From a different perspective, the inner case 61 of the right wall module 14 may include the convex portion 62. The convex portion 62 may include an outer wall 63, an inner wall 64, and a top wall 65 connecting between the outer wall 63 and the inner wall 64. The outer wall 63 and the inner wall 64 may be formed in parallel to face each other. The outer wall 63 may be formed on a farther outside than the inner wall 64 with respect to the storeroom 21.

The convex portion 62 may include an insulation filling space 66 where the insulation 69 is filled. As the insulation 69 is filled in the insulation filling space 66, the convex portion 62 may have enough rigidity.

The convex portion 62 may be engaged with the concave portion 42. That is, the convex portion 62 may be inserted to the concave portion 42. The outer wall 63 of the convex portion 62 may adjoin the outer wall 43 of the concave wall 33, the top wall 65 of the convex portion 62 may adjoin the bottom wall 45 of the concave portion 42, and the inner wall 64 of the convex portion 62 may adjoin the inner wall 44 of the concave portion 42. In this way, the convex portion 62 comes into contact with the concave portion 42 on three sides, so that coupling power and airtightness between the right wall module 14 and the rear wall module 12 may increase.

After the convex portion 62 of the right wall module 14 and the concave portion 42 of the rear wall module 12 are assembled to be engaged with each other, the fastening member S2 may be fastened to the right wall module 14 and the rear wall module 12. The fastening member S2 may be fastened to the convex portion 62 of the right wall module 14 by penetrating the outer case 38 and the inner case 31 of the rear wall module 12.

For this, a fastening groove 67 to which the fastening member S1 is fastened may be formed in the convex portion 62. The fastening member S2 may be a screw with an outer circumferential surface on which a thread is formed. A thread may be formed on an inner circumferential surface of the fastening groove 67 to correspond to the screw.

The fastening groove 67 may be formed not to be connected to the insulation filling space 66 to prevent the foaming liquid injected and foamed in the insulation filling space 66 from leaking into the fastening groove 67. That is, the convex portion 62 may include a partition wall 65*a* formed to partition the insulation filling space 66 from the fastening groove 67. The fastening member S2 may be fastened in a direction from the outer wall 63 of the convex portion 62 to the inner wall 64.

In this way, the convex portion 62 and the concave portion 42 are assembled to be engaged with each other and the fastening member S2 is then fastened to the convex portion 62, thereby improving durability and airtightness between the right wall module 11 and the rear wall module 12.

The guide projection 70, the guide groove 75, and the connectors 82 and 83 are the same as in the case of the aforementioned top wall module and right wall module, so the description will not be repeated. In FIG. 9, electrical wiring 84 is installed at the right wall module 14.

The coupling structure between the top wall module 11 and the rear wall module 12 and the coupling structure between the right wall module 14 and the rear wall module 12 have thus far been described. Such coupling structures may be equally applied to coupling structures between other wall modules.

Figure 10:
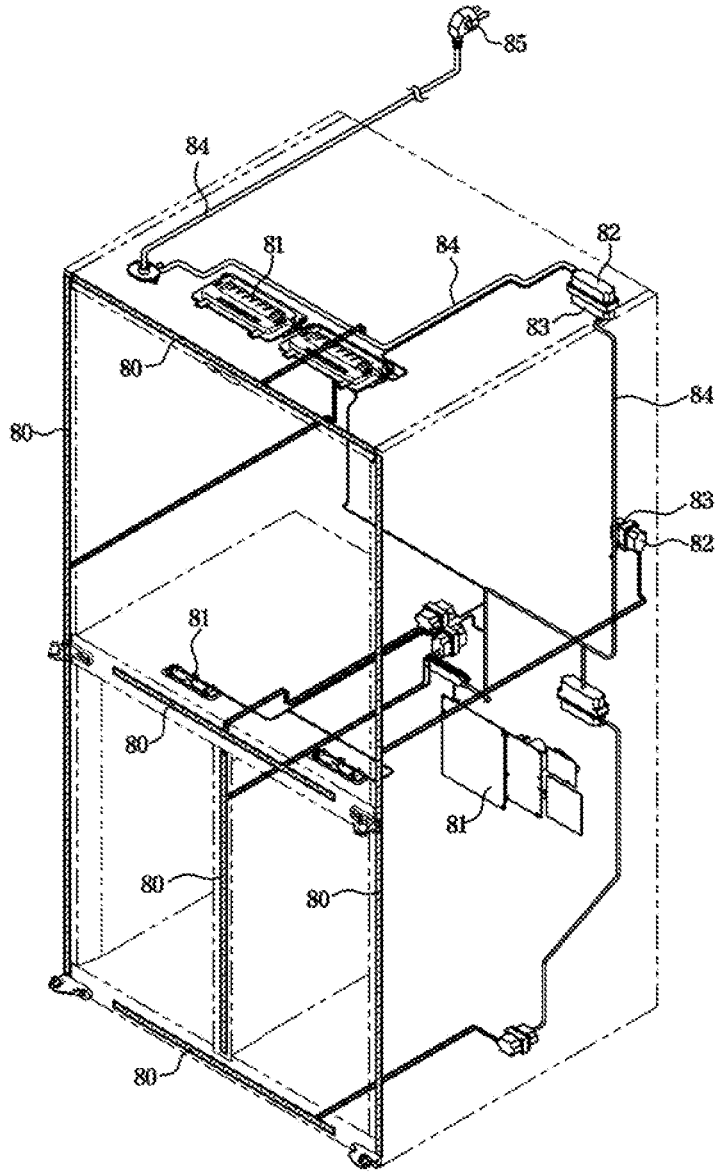
FIG. 10 shows electrical wiring and connectors of the refrigerator of FIG. 1.

FIG. 10 shows electrical wiring and connectors of the refrigerator of FIG. 1.

Referring to FIG. 10, electrical connections between the plurality of wall modules according to an embodiment of the disclosure is described.

The plurality of wall modules may include a heater 80 or other various kinds of electric parts 81. For example, the heater 80 for preventing dew formation caused by a difference in temperature may be installed on the front side of the top wall module 11, left wall module 13, right wall module 14, bottom wall module 15, horizontal middle wall module 16, and vertical middle wall module 17 adjacent to the door.

The plurality of wall modules may include electrical wiring 84 connected to the heater 80 and the electric parts 81 to supply power to the heater 80 and the electric parts 81. The electrical wiring 84 may be connected to a plug 85 connected to an external power source. The plurality of wall modules may include the connectors 82 and 83 through which the plurality of wall modules are electrically interconnected.

Figure 11:
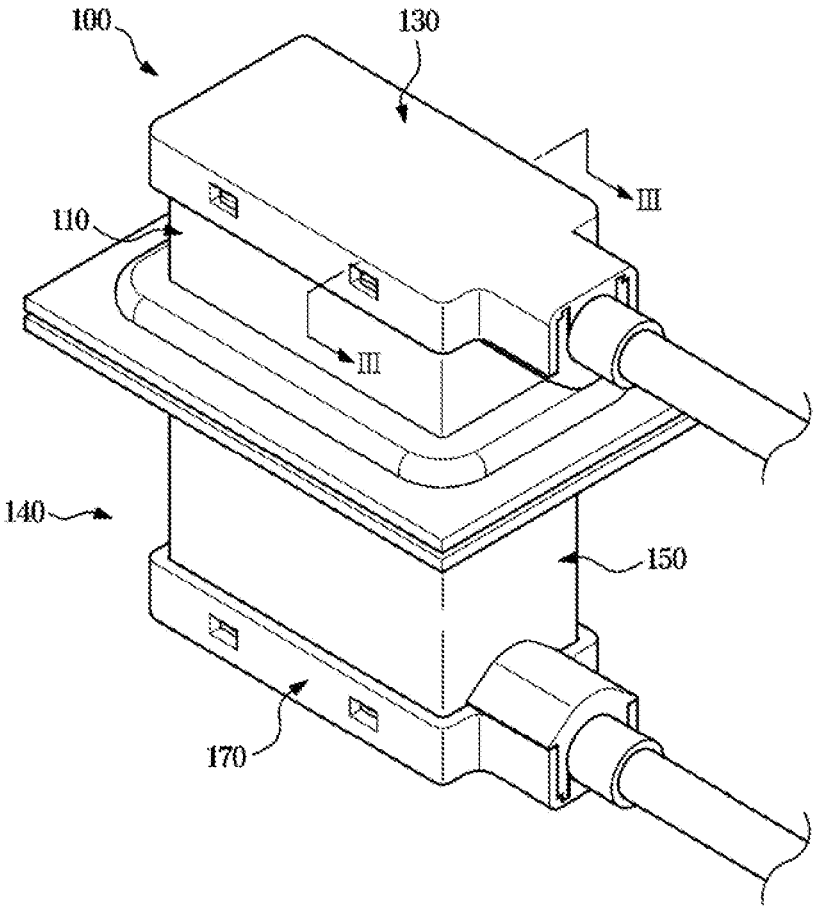
FIG. 11 shows in detail a pair of connectors of the refrigerator of FIG. 1 connected to each other.
Figure 12:
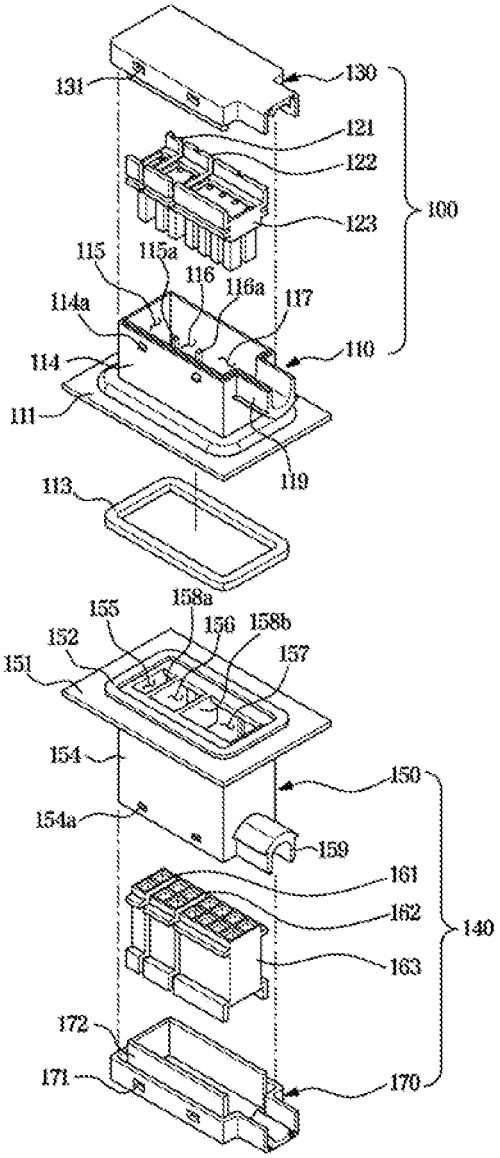
FIG. 12 is an exploded view of the connectors of FIG. 11.
Figure 13:
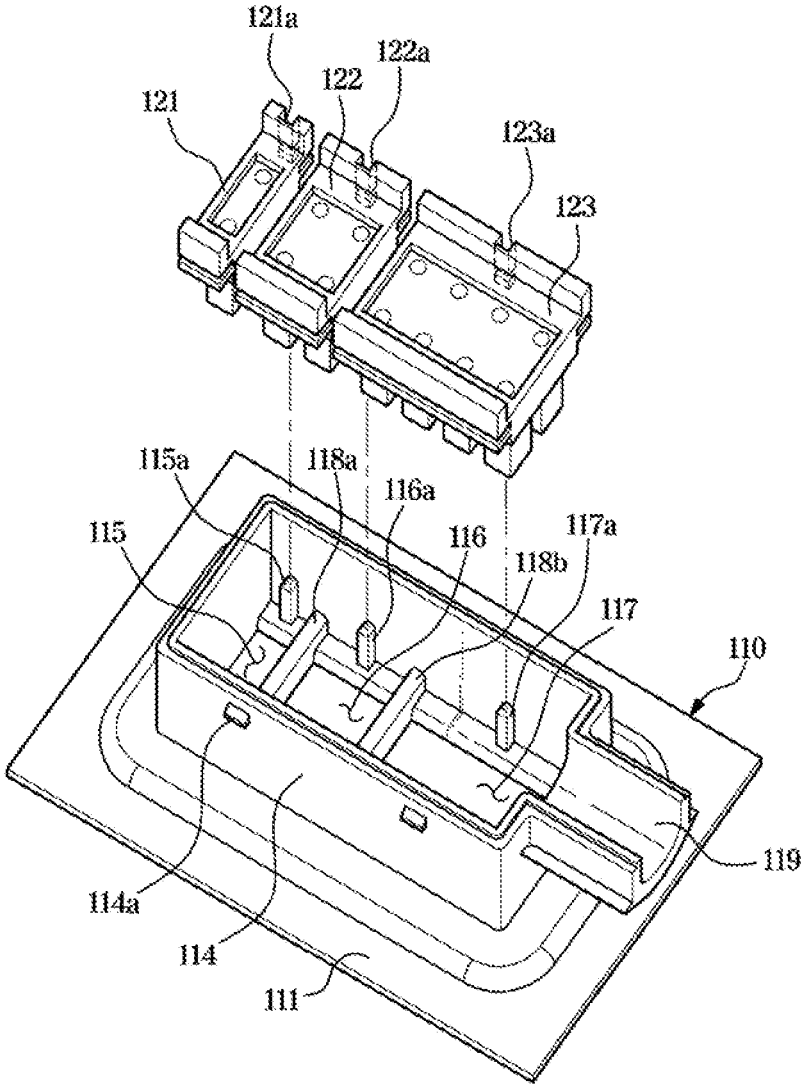
FIG. 13 shows a first connector of FIG. 11.
Figure 14:
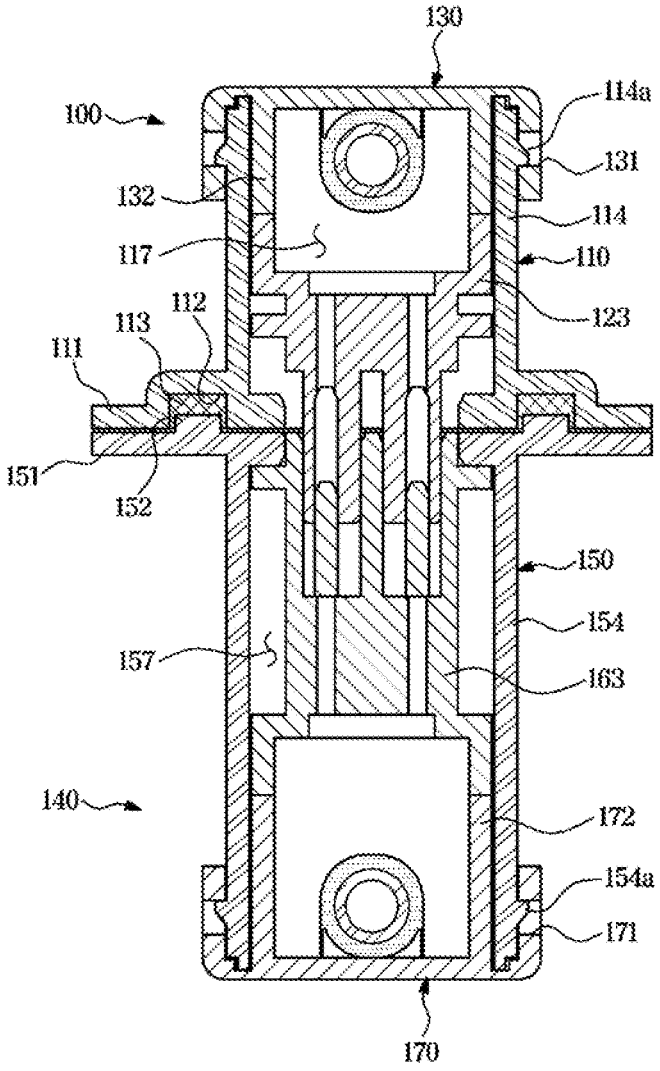
FIG. 14 is a cross-sectional view along line III-III of FIG. 11.
Figure 15:
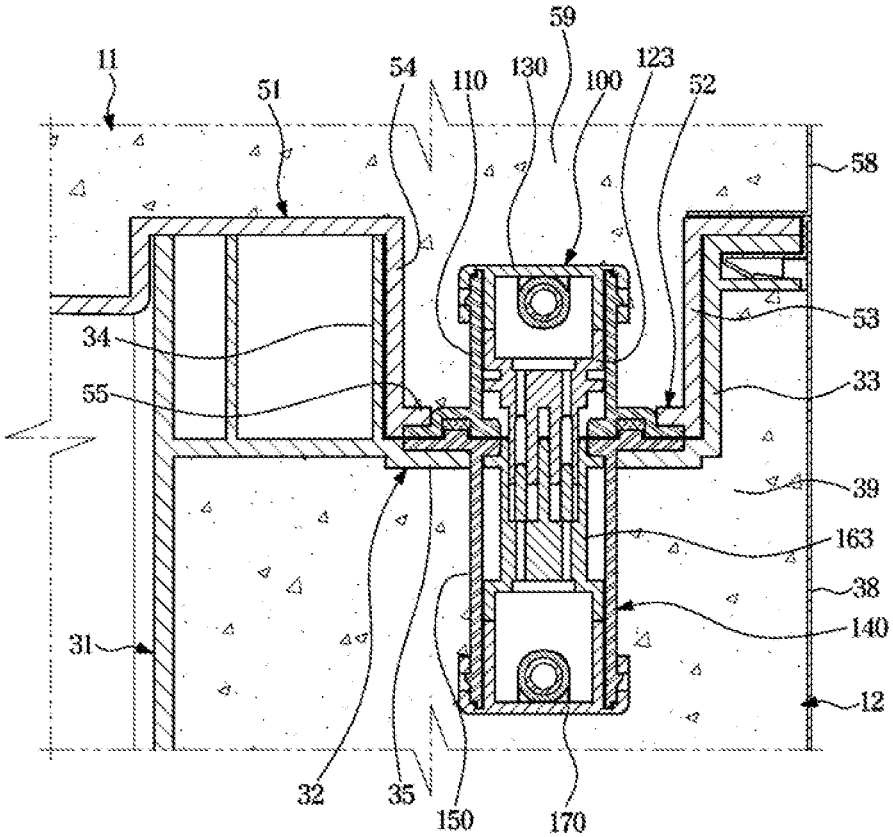
FIG. 15 shows an installation structure of connectors of FIG. 11.

FIG. 11 shows in detail a pair of connectors of the refrigerator of FIG. 1 connected to each other. FIG. 12 is an exploded view of the connectors of FIG. 11. FIG. 13 shows a first connector of FIG. 11. FIG. 14 is a cross-sectional view along line III-III of FIG. 11. FIG. 15 shows an installation structure of the connectors of FIG. 11.

Connectors 100 and 140 shown in FIGS. 11 and 15 are the detailed version of the connectors 82 and 83 of FIG. 10.

The male connector 100 may have male terminal housings 121, 122, and 123, and the female connector 140 may have female terminal housings 161, 162, and 163 to which the male terminal housings 121, 122, and 123 are inserted.

As shown in FIG. 15, the male connector 100 may be installed at the convex portion 52. For example, the male connector 100 may be installed to penetrate the top wall 55 of the concave portion 52. The female connector 140 may be installed at the concave portion 32. For example, the female connector 140 may be installed to penetrate the bottom wall 35 of the concave portion 32. However, unlike in this embodiment, it is, of course, possible to install the male connector 100 at the concave portion and the female connector 140 at the convex portion.

The male connector 100 may include a connector case 110, the terminal housings 121, 122, and 123 mounted in the connector case 110, and a connector cover 130 coupled to cover an open side of the connector case 110.

The connector case 110 may include a case body 114 on which installation parts 115, 116, and 117 equipped with the terminal housings 121, 122, and 123 are formed, and a flange 111 extending outward from the case body 114 to be supported on the top wall 55 of the convex portion 52.

The installation parts 115, 116, and 117 may be provided in different sizes to allow the terminal housings 121, 122, and 123 having different sizes to be installed thereon. The first terminal housing 121 may be installed on the first installation part 115, the second terminal housing 122 may be installed on the second installation part 116, and the third terminal housing 123 may be installed on the third installation part 117.

The connector case 110 may include installation ribs 115*a*, 116*a* and 117*a* inserted and coupled to installation grooves 121*a*, 122*a*, and 123*a* of the terminal housings 121, 122, and 123, respectively. The connector case 110 may include guide ribs 118*a* and 118*b* for guiding installation of the terminal housings 121, 122, and 123.

A catching projection 114*a* may be formed on the case body 114 of the connector case 110 to be coupled with the connector cover 130.

A sealing groove 112 equipped with a sealing member 113 may be formed on the flange 111 of the connector case 110. The sealing member 113 may be pressurized and compressed by a pressurizing projection 152 formed at the female connector 140. As the sealing member 113 is compressed, airtightness between the male connector 100 and the female connector 140 may increase. Unlike in this embodiment, it is, of course, possible that the pressurizing projection may be formed at the male connector 100 and the sealing groove 112 may be formed at the female connector 140.

The connector case 110 may include a harness inlet 119 into which a harness to be connected to the terminal housings 121, 122, and 123 is placed.

The connector cover 130 may be coupled to the connector case 110 to cover an open side of the connector case 110. The connector cover 130 may have a catching groove 131 to which the catching projection 114*a* of the connector case 110 is inserted and coupled.

The connector cover 130 may include a supporter 132 that supports the terminal housings 121, 122, and 123 mounted in the connector case 110. The supporter 132 may prevent the terminal housings 121, 122, and 123 of the male connector 100 from being pressed and pushed by the terminal housings 161, 162, and 163 of the female connector 140 when the male connector 100 is coupled to the female connector 140.

The female connector 140 may include a connector case 150, the terminal housings 161, 162, and 163 mounted in the connector case 150, and a connector cover 170 coupled to cover an open side of the connector case 150.

The connector case 150 may include a case body 154 on which installation parts 155, 156, and 157 equipped with the terminal housings 161, 162 and 163 are formed, and a flange 151 extending outward from the case body 154 to be supported on the bottom wall 35 of the concave portion 32.

The installation parts 155, 156, and 157 may be provided in different sizes to allow the terminal housings 161, 162 and 163 having different sizes to be installed thereon. The first terminal housing 161 may be installed on the first installation part 155, the second terminal housing 162 may be installed on the second installation part 156, and the third terminal housing 163 may be installed on the third installation part 157.

The connector case 150 may include an installation rib inserted and coupled to the installation groove of each of the terminal housings 161, 162 and 163. The connector case 150 may include guide ribs 158*a* and 158*b* for guiding installation of the terminal housings 161, 162, and 163.

A catching projection 154*a* may be formed on the case body 154 of the connector case 150 to be coupled with the connector cover 170.

The pressurizing projection 152 may be formed to protrude from the flange 151 of the connector case 150 to pressurize the sealing member 113 equipped in the male connector 100.

The connector case 150 may include a harness inlet 159 into which a harness to be connected to the terminal housings 161, 162, and 163 is placed.

The connector cover 170 may be coupled to the connector case 150 to cover an open side of the connector case 150. The connector cover 170 may have a catching groove 171 to which the catching projection 154*a* of the connector case 150 is inserted and coupled.

The connector cover 170 may include a supporter 172 that supports the terminal housings 161, 162 and 163 mounted in the connector case 150.

While the disclosure has been shown and described with reference to example embodiments, it will be understood by those skilled in the art that various changes in form and details may be made therein without departing from the spirit and scope of the disclosure as defined by the appended claims and their equivalents.

The invention claimed is:

1. A refrigerator, comprising:

a main body including a plurality of wall modules, wherein the plurality of wall modules include a first wall module having a concave portion, and a second wall module having a convex portion engaged with the concave portion, and the convex portion includes an insulation filling space filled with insulation, and a fastening groove;

a storeroom disposed inside the main body to store food;

a door arranged to open or close the storeroom; and a fastening member inserted into the fastening groove and fastened to the first wall module and the second wall module, wherein the first wall module includes a guide projection which protrudes from the concave portion, the second wall module includes a guide groove recessed at the convex portion to correspond to the guide projection, the concave portion includes an outer wall, an inner wall, and a bottom wall disposed between the outer wall and the inner wall, and the guide projection protrudes from the bottom wall of the concave portion.

2. The refrigerator of claim 1, wherein the insulation filling space and the fastening groove are not interconnected.

3. The refrigerator of claim 1, wherein the convex portion includes an outer wall, an inner wall, and a top wall disposed between the outer wall and the inner wall.

4. The refrigerator of claim 1, wherein the convex portion includes a partition wall which partitions the insulation filling space from the fastening groove.

5. The refrigerator of claim 3, wherein the fastening member is fastened in a direction from the outer wall toward the inner wall.

6. The refrigerator of claim 1, wherein the guide projection includes a sloped guide surface formed to slope to the bottom wall to adjust a position of the guide projection when the guide projection is inserted into the guide groove.

7. The refrigerator of claim 1, wherein the guide projection includes a vertical guide surface which is perpendicular to the bottom wall, and the vertical guide surface is disposed between the sloped guide surface and the bottom wall.

8. The refrigerator of claim 1, wherein the guide projection is symmetrically formed with respect to a central surface of the guide projection that is perpendicular to a direction of length of the concave portion.

9. The refrigerator of claim 1, further comprising:

a plurality of connectors arranged in the first wall module and the second wall module to electrically interconnect the first wall module with the second wall module when the first and second wall modules are coupled together.

10. The refrigerator of claim 9, wherein the plurality of connectors include a first connector installed in the concave portion and a second connector installed in the convex portion.

11. The refrigerator of claim 9, wherein the plurality of connectors include:

a first connector having a sealing groove equipped with a sealing member, and a second connector having a pressurizing rib which protrudes to pressurize the sealing member when the second connector is coupled to the first connector.

12. The refrigerator of claim 9, wherein the first wall module and second wall module include:

electrical wiring, and a heater to prevent dew formation, wherein the heater is configured to be supplied with power via the electrical wiring and the plurality of connectors which electrically interconnect the first wall module with the second wall module.

* * * * *